US009310732B2

(12) United States Patent
Yamane

(10) Patent No.: US 9,310,732 B2
(45) Date of Patent: Apr. 12, 2016

(54) FIXING DEVICE AND IMAGE FORMING APPARATUS

(71) Applicant: KYOCERA Document Solutions Inc., Osaka (JP)

(72) Inventor: Shinji Yamane, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/737,228

(22) Filed: Jun. 11, 2015

(65) Prior Publication Data

US 2015/0378286 A1 Dec. 31, 2015

(30) Foreign Application Priority Data

Jun. 30, 2014 (JP) ..... 2014-134278

(51) Int. Cl.
*G03G 15/20* (2006.01)

(52) U.S. Cl.
CPC ..... *G03G 15/206* (2013.01); *G03G 15/2053* (2013.01); *G03G 15/2057* (2013.01); *G03G 15/2064* (2013.01); *G03G 15/2089* (2013.01); *G03G 2215/2048* (2013.01)

(58) Field of Classification Search
CPC ..... G03G 15/20
USPC ..... 399/333
See application file for complete search history.

(56) References Cited

U.S. PATENT DOCUMENTS

2010/0129123 A1* 5/2010 Natori et al. ..... 399/333
2014/0348559 A1* 11/2014 Miyahara ..... 399/333

FOREIGN PATENT DOCUMENTS

JP 2000-155488 * 6/2000 ..... G03G 15/20
JP 2000-155488 A 6/2000

* cited by examiner

*Primary Examiner* — Clayton E Laballe
*Assistant Examiner* — Kevin Butler
(74) *Attorney, Agent, or Firm* — Studebaker & Brackett PC

(57) ABSTRACT

The fixing device includes a fixing member heated from inside; and a pressing member forming a fixing nip with the fixing member. A toner image transferred on a sheet is heated and pressed so as to be fixed on the sheet at the fixing nip through which the sheet is nipped and conveyed. The fixing member includes, on an inner circumferential surface thereof, a heat absorbing layer containing heat-conductive fillers oriented in a direction intersecting with a conveying direction of the sheet.

10 Claims, 3 Drawing Sheets

FIXING DEVICE AND IMAGE FORMING APPARATUS

INCORPORATION BY REFERENCE

This application is based on and claims the benefit of priority from Japanese Patent application No. 2014-134278 filed on Jun. 30, 2014, the entire contents of which are incorporated herein by reference.

BACKGROUND

The present disclosure relates to a fixing device configured to fix an toner image on a sheet and an image forming apparatus including the fixing device.

In an image forming apparatus, an image carrier such as a photosensitive drum is charged and then exposed based on image data to form an electrostatic latent image on the surface, and the electrostatic latent image is developed into a toner image by a development unit. The toner image formed on the surface of the image carrier is transferred to a sheet and then fixed to the sheet by a fixing device.

Some of the fixing devices are configured to heat a belt-like or a roller-type fixing member by a heat source and to heat and press the toner image between the heated fixing member and a pressing member, thereby melting and pressing the toner image to fix on the sheet.

In recent years, there is a tendency to reduce a heat capacity of the fixing member in response to an environmental issue. As a measure to reduce a heat capacity, the fixing member may be made thin. However, if the fixing member is made thin, there arises such a problem that a heat conductivity thereof in a direction (a sheet width direction) intersecting with a sheet conveying direction deteriorates and temperature unevenness is easy to occur in the sheet width direction.

The fixing member is configured such that the entire region in the sheet width direction is heated regardless of sheet size. Therefore, after a small size sheet passes through the fixing member, while a temperature of the sheet passing region lowers because a heat quantity is transmitted to the sheet, a heat quantity in a non-sheet passing region outside of the sheet passing region is not transmitted to the sheet but remains. If a heat conductivity in the sheet width direction is low, since the remaining heat quantity is hardly transmitted in the sheet width direction, unevenness of temperature occurs between the small size sheet passing region and the non-sheet passing region. Then, if a large size sheet passes through after passing the small size sheet, image deterioration called as a hot offset phenomenon or unevenness of gloss caused by the unevenness of temperature are easy to occur. Still further, because the heat quantity remains locally, there is a case when the fixing member or a member arranged near the fixing member is deteriorated by the heat.

To cope with this problem, the fixing device may be controlled such that the fixing operation waits until the unevenness of temperature is eliminated by lowering a sheet conveying speed or temporarily stopping the conveyance of the sheet. However, if the waiting time is long, there arises a problem that a printing productivity of small size sheet deteriorates.

Then, there is a fixing member configured to have a two-layer tubular structure in which a graphite layer having an anisotropic heat conductivity is provided between the two layer tubes to increase the heat conductivity in an axial direction.

However, this fixing member has a problem that it is costly because the configuration of the multi-layer tubular structure is complicated and its molding steps increases. There is also another problem that a power consumption increases and a power saving performance deteriorates because a heat capacity increases by adding the graphite layer.

SUMMARY

In accordance with an embodiment of the present disclosure, the fixing device includes a fixing member heated from inside and a pressing member forming a fixing nip with the fixing member. A toner image transferred on a sheet is heated and pressed so as to be fixed on the sheet at the fixing nip through which the sheet is nipped and conveyed. The fixing member includes, on an inner circumferential surface thereof, a heat absorbing layer containing heat-conductive fillers oriented in a direction intersecting with a conveying direction of the sheet.

In accordance with an embodiment of the present disclosure, an image forming apparatus includes a fixing device. The fixing device has a fixing member heated from inside and a pressing member forming a fixing nip with the fixing member. A toner image transferred on a sheet is heated and pressed so as to be fixed on the sheet at the fixing nip through which the sheet is nipped and conveyed. The fixing member includes, on an inner circumferential surface thereof, a heat absorbing layer containing heat-conductive fillers oriented in a direction intersecting with a conveying direction of the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference the drawings, a fixing device and an image forming apparatus according to an embodiment of the present disclosure will be described.

Figure 1:
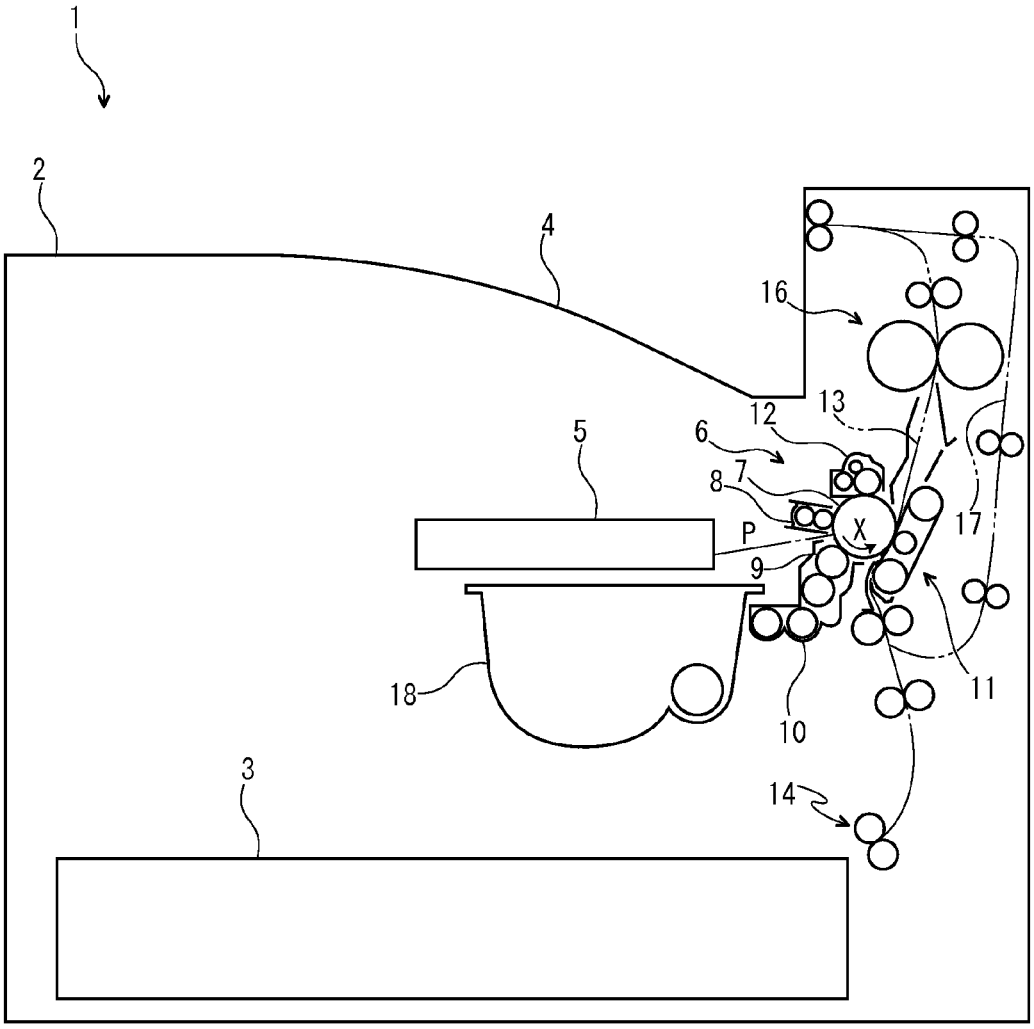
FIG. 1 is a schematic diagram illustrating a configuration of a printer according to one embodiment of the present disclosure.

With reference to FIG. 1, a printer (an image forming apparatus) according to one embodiment of the present disclosure will be described. FIG. 1 is a schematic diagram illustrating a configuration of the printer. In the following description, a near side on a paper plane indicates a front side of the printer 1 and left and right directions are based on a direction viewed from the front side of the printer.

The printer 1 includes a box-formed printer main body 2. In a lower part of the printer main body 2, a sheet feeding cartridge 3 storing a sheet (recording material) is arranged and, on a top face of the printer main body 2, a sheet ejected tray 4 is formed.

In a middle part inside the printer main body 2, an exposure device 5 composed of a laser scanning unit (LSU) is arranged and, in a right middle part inside the printer main body 2, an image forming part 6 is provided. In the image forming part 6, a photosensitive drum 7 (an image carrier) is rotatably arranged (for example, a linear velocity of 300 mm/s). The photosensitive drum 7 is made of amorphous silicon of a diameter of 30 mm, for example. Around the photosensitive drum 7, a charger 8, a development unit 10 having a development roller 9, a transferring device 11 and a cleaning device 12 are located along a rotating direction (refer to an arrow X in FIG. 1) of the photosensitive drum 7. The development unit 10 is connected to a toner container 18 storing a toner (developer).

In a right side part inside the printer main body 2, a sheet conveying path 13 from the sheet feeding cartridge 3 toward the sheet ejected tray 4 is provided. At an upstream end in the conveying path 13, a sheet feeding part 14 is provided. At an intermediate stream part in the conveying path 13, the transferring device 11 is provided. At a downstream part in the conveying path 13, a fixing device 16 is provided. On a right side of the sheet conveying path 13, an inversion path 17 for duplex printing is provided.

Next, the operation of forming an image by the printer 1 having such a configuration will be described. When image data is inputted and a printing start is directed from a computer or the like connected with the printer 1, image forming operation is carried out as follows.

First, a surface of the photosensitive drum 7 is electric-charged by the charger 8. Then, exposure corresponding to the image data on the photosensitive drum 7 is carried out by a laser light (refer to a dashed line P in FIG. 1) from the exposure device 5, thereby forming an electrostatic latent image on the surface of the photosensitive drum 7. Subsequently, the electrostatic latent image is developed by the development unit 10 into a toner image with the toner supplied from the toner container 18.

On the other hand, a sheet fed from the sheet feeding cartridge 3 by the sheet feeding part 14 is conveyed to the image forming part 6 in a suitable timing for the above-mentioned image forming operation, and then, the toner image on the photosensitive drum 7 is transferred on the sheet in the transferring device 11. The sheet with the transferred toner image is conveyed to a downstream side in the conveying path 13 to go forward to the fixing device 16, and then, the toner image is fixed on the sheet in the fixing device 16. The sheet with the fixed toner image is ejected from the downstream end in the conveying path 13 to the sheet ejected tray 4. The toner remained on the photosensitive drum 7 is collected by the cleaning device 12.

Figure 2:
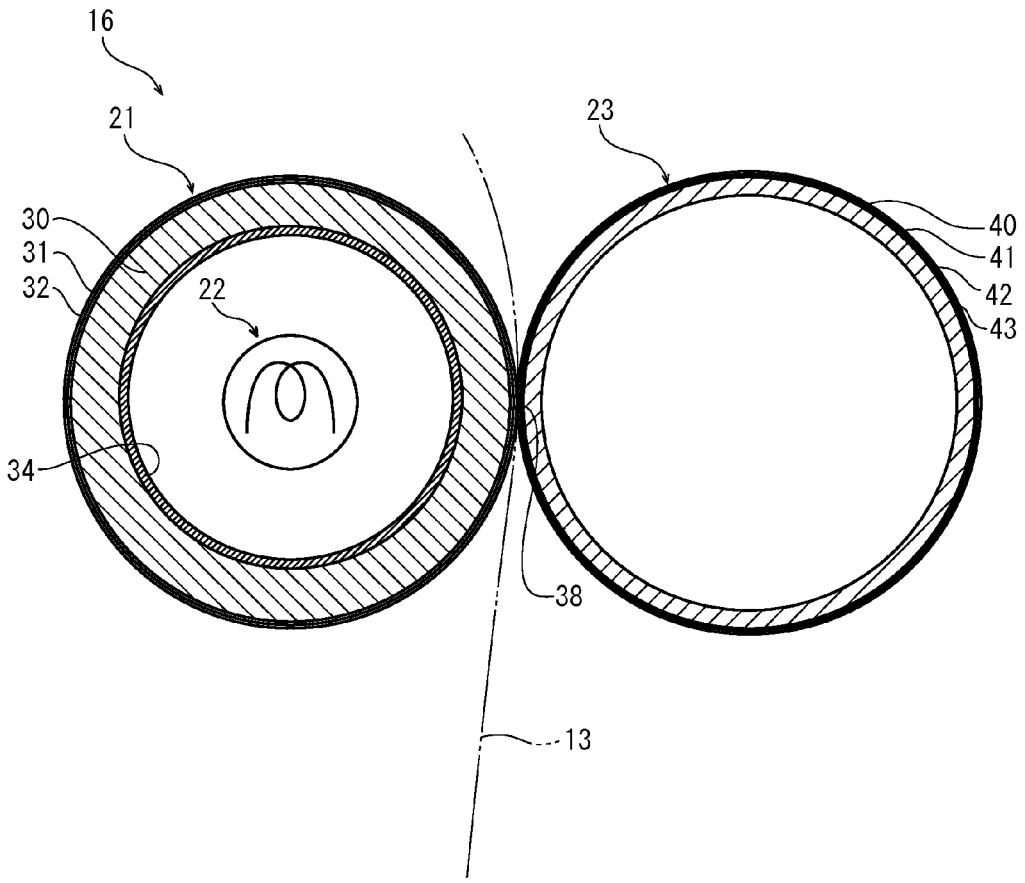
FIG. 2 is a section view schematically illustrating a fixing device according to one embodiment of the present disclosure.
Figure 3A:
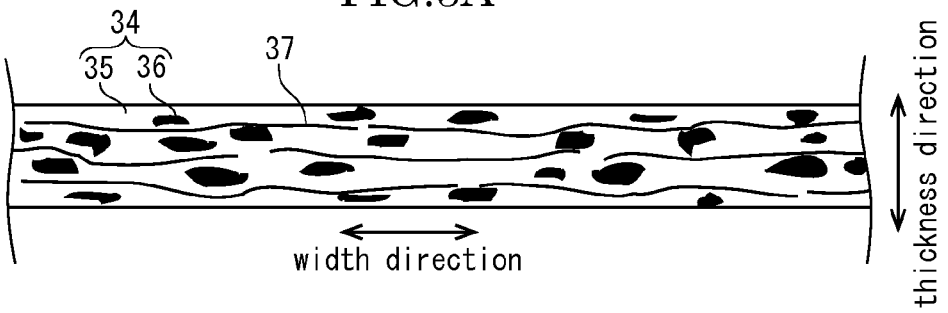
FIG. 3A is a side sectional view of a heat absorbing layer containing fibrous heat-conductive fillers, in the fixing device of one embodiment of the present disclosure.
Figure 3B:
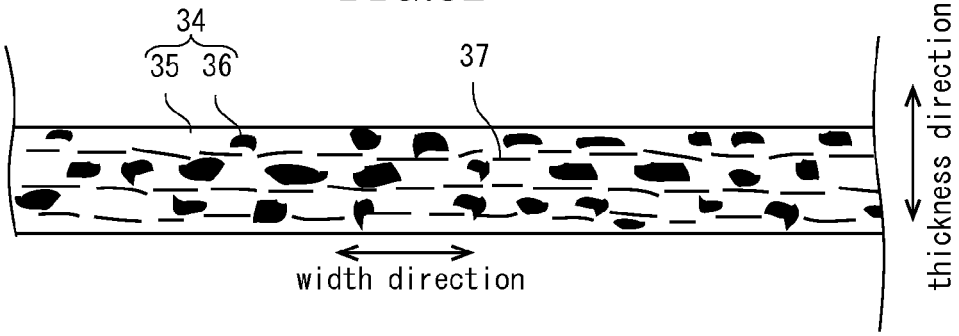
FIG. 3B is a side sectional view of a heat absorbing layer containing needle-like heat-conductive fillers, in the fixing device of one embodiment of the present disclosure.
Figure 3C:
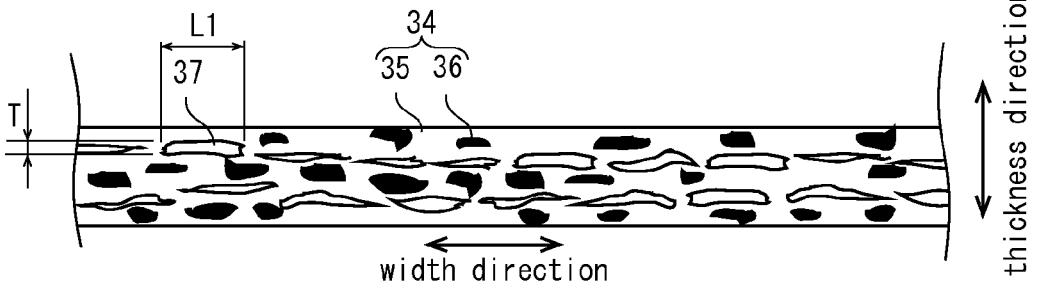
FIG. 3C is a side sectional view of a heat absorbing layer containing scale-like heat-conductive fillers, in the fixing device of one embodiment of the present disclosure.
Figure 3D:
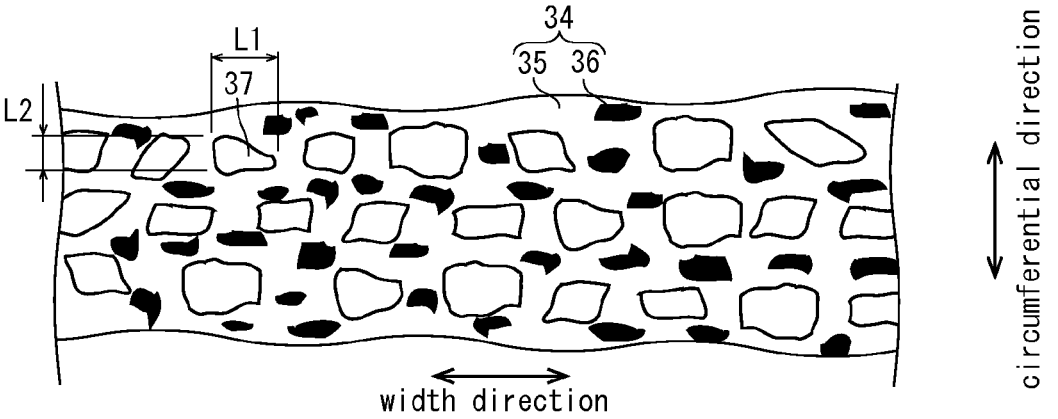
FIG. 3D is a plan view of the heat absorbing layer containing the scale-like heat-conductive fillers, in the fixing device of one embodiment of the present disclosure.

Next, the fixing device 16 will be described with reference to FIGS. 2 and 3A through 3D. FIG. 2 is a front view schematically showing the fixing device and FIGS. 3A through 3D schematically illustrate structures of heat absorbing layers of the fixing member. That is, FIG. 3A is a side section view of the heat absorbing layer containing fibrous heat-conductive fillers, FIG. 3B is a side section view of the heat absorbing layer containing needle-like heat-conductive fillers, FIG. 3C is a side section view of the heat absorbing layer containing scale-like heat-conductive fillers, and FIG. 3D is a plan view of the heat absorbing layer containing the scale-like heat-conductive fillers.

As shown in FIG. 2, the fixing device 16 includes a fixing roller (a fixing member) 21 heated from inside thereof, a halogen heater (a heat source) 22 heating the fixing roller 21, and a pressing roller (a pressing member) 23 in pressure contact with the fixing roller 21.

The fixing roller 21 is rotatably supported by the printer main body 2, and has a cylindrical core metal 30 and a release layer 32 provided on an outer circumferential surface of the core metal 30 with an adhesive layer 31. The core metal 30 may be an aluminum tube having a thickness of 0.55 mm, for example. The adhesive layer 31 has a thickness of 5 μm to 1 μm, is made of fluorine-based resin, such as PFA (tetrafluoroethylene-perfluoroalkyl vinyl ether copolymer) and PTFE (polytetrafluoroethylene), primer, such as PI (polyimide), and electrical conductive material, such as carbon and metallic particles including aluminum, and has an electrical conductivity. The release layer 32 has a thickness of 10 μm, to 15 μm, for example, is made of fluorine-based resin, such as PFA and PTFE, and has an insulation property.

On an inner circumferential surface of the core metal 30, a heat absorbing layer 34 is provided. The heat absorbing layer 34 has a thickness of 5 μm to 30 μm, for example, and is formed of abase layer 35 containing fillers (heat absorbing fillers) 36 having a high heat absorbability, as shown in FIG. 3A through 3D.

The base layer 35 is made of a resin having a heat resistance to temperature around 200° C. to 300° C. and a high binding capability with the core metal 30. As such resin, silicon resin, fluorine resin, PI or the like, for example, may be used. As the heat absorbing fillers 36, carbon and graphite, for example, may be used.

In the heat absorbing layer 34, high heat-conductive fillers (heat-conductive filler) 37 (a heat conductivity is, e.g., 100 W/(m·k) to 6000 W/(m·k)) are contained. A content of the heat-conductive fillers 37 is 3 wt % to 50 wt %, for example. As the heat-conductive filler 37, carbon, copper, alumina, boron nitride, silicon nitride or the like can be used.

The heat-conductive filler 37 has a fibrous, needle-like or scale-like shape and is oriented in a direction (a sheet width direction) intersecting with a sheet conveying direction. That is, the heat-conductive filler 37 has a length in the sheet width direction longer than a thickness in a thickness direction of the heat absorbing layer 34 and is aligned such that a lengthwise direction thereof is oriented along the sheet width direction. Still further, the length of the heat-conductive filler 37 in the sheet width direction is preferable to be longer than the thickness of the heat absorbing layer 34. The length of the scale-like heat-conductive filler 37 is indicated by an average diameter represented by an average value of a length L1 in the sheet width direction and a length L2 in a circumferential direction (a direction perpendicular to the sheet width direction) as shown in FIG. 3D. Furthermore, the heat-conductive fillers 37 are aligned on lines in the sheet width direction.

As shown in FIG. 3A, the fibrous heat-conductive fillers 37 are aligned on lines in the sheet width direction so as to orient the lengthwise direction along the sheet width direction.

As shown in FIG. 3B, the needle-like heat-conductive fillers 37 are also aligned on lines in the sheet width direction so as to orient the lengthwise direction along the sheet width direction.

As shown in FIGS. 3C and 3D, the scale-like heat-conductive fillers 37 are layered (spread) such that a flat surface thereof is substantially in parallel with the inner circumferential surface of the fixing roller 21 (the surface of the heat absorbing layer 34). That is, a length L1 in the sheet width direction is longer than a thickness T in the thickness direction of the heat absorbing layer 34. Still further, the fillers are aligned on lines in the sheet width direction and oriented such that the length L1 in the sheet width direction is longer than the length L2 in the circumferential direction.

The heat-conductive fillers 37 can be oriented in the sheet width direction as follows for example. A raw material of the base layer 35 containing the heat-conductive fillers 37 is applied on the inner circumferential surface of the core metal 30 of the fixing roller 21 while leaving a predetermined space from the inner circumferential surface of the core metal 30 by a ring-like coating member from one end to another end in the sheet width direction. Then, the raw material applied on the inner circumferential surface is swept (scanned) in the sheet width direction. This makes it possible to steadily orient the heat-conductive fillers 37 along the sheet width direction.

The halogen heater 22 is arranged inside the fixing roller 21. The halogen heater 22 radiates radiant heat to the inner circumferential surface of the fixing roller 21.

The pressing roller 23 is rotatably supported by the printer main body 2 and comes in pressure contact with the fixing roller 21. Then, a fixing nip 38 is formed between the fixing roller 21 and the pressing roller 23.

The pressing roller 23 includes a cylindrical core metal 40, an elastic layer 41 provided on an outer circumferential surface of the core metal 40, and a release layer 43 provided on an outer circumferential surface of the elastic layer 41 with an adhesive layer 42. The core metal 40 has an outer diameter of 12 mm, for example, and is made of metal, such as aluminum and stainless steel. The elastic layer 41 is made of a silicon rubber layer having a thickness of 3 μm to 10 μm, for example. The adhesive layer 42 is made of a silicon-based adhesive having a thickness of 5 μm to 20 μm, for example. The release layer 43 is made of fluorine-based resin, such as PFA and PTFE, having a thickness of 30 μm to 50 μm, for example.

In the fixing device 16 constructed as described above, when the toner is fixed on the sheet, the halogen heater 22 is operated to heat the fixing roller 21. Radiant heat irradiated from the halogen heater 22 is absorbed in the heat absorbing layer 34 of the fixing roller 21. In the heat absorbing layer 34, a heat energy of the absorbed radiant heat is transferred to the core metal 30 to heat the core metal 30. Due to the heating of the core metal 30, the adhesive layer 31 and the release layer 32 are also heated. That is, the heat energy absorbed in the heat absorbing layer 34 is transferred in the thickness direction of the fixing roller 21.

The heat energy absorbed in the heat absorbing layer 34 is also transferred in the sheet width direction by the heat-conductive fillers 37. That is, because the lengthwise direction of the heat-conductive fillers 37 is oriented along the sheet width direction, the heat is transferred in the sheet width direction within the heat-conductive fillers 37. The heat is also transferred from an end of the heat-conductive fillers 37 to an end of an adjacent heat-conductive filler 37 through the base layer 35 and the heat absorbing filler 36. At this time, if the heat-conductive fillers 37 are aligned on lines in the sheet width direction, a heat conductivity further improves because a distance between the adjacent heat-conductive fillers 37 is shortened. Thus, the heat is readily spread in the sheet width direction within the heat absorbing layer 34 by the heat conductive performance of the heat-conductive fillers 37.

After the fixing roller 21 is heated up to a desirable temperature, the fixing roller 21 is rotated and the pressing roller 23 in pressure contact with the fixing roller 21 rotates in a direction opposite to the rotating direction of the fixing roller 21. When the sheet conveyed along the conveying path 13 passes through the fixing nip 38 in this state, the toner image is heated and pressed to be fixed on the sheet.

In the case of a small size sheet, after fixing the toner, a heat quantity in the non-sheet passing region outside of the sheet passing region of the fixing roller 21 is not transferred to the sheet but remains. However, because this heat quantity is transferred inwardly in the sheet width direction and dispersed by the heat-conductive fillers 37 within the heat absorbing layer 34, an excessive temperature rise in the non-sheet passing region does not occur.

As described above, in the fixing device 16 according to the embodiment, since the heat-conductive fillers 37 are oriented within the heat absorbing layer 34 provided on the inner circumferential surface of the fixing roller 21 so as to have a high heat conductivity in the sheet width direction, the heat quantity remaining in the non-sheet passing region outside of the small sheet passing region is quickly transferred in the sheet width direction within the heat absorbing layer 34. Accordingly, it makes it possible to prevent the excessive temperature rise in the non-sheet passing region outside of the sheet passing area and to reduce the unevenness of temperature after passing the small size sheet.

Accordingly, it become possible to prevent the deterioration of image quality, such as the offset phenomenon and the unevenness of gloss, and also the thermal deformation of the members arranged near the non-sheet passing region. Still further, it becomes possible to shorten the waiting time until a temperature distribution in the sheet width direction is eliminated. Therefore, the fixing roller 21 can be made thin to keep power consumption low while preventing deterioration of the printing productivity of small size sheet.

Still further, the heat conductivity in the sheet width direction can be enhanced by a relatively easy and inexpensive method by just containing the heat-conductive fillers 37 in the raw material of the heat absorbing layer 34 and then applying the raw material on the inner circumferential surface of the fixing roller 21 along the sheet width direction.

Still further, because the heat-conductive fillers 37 are aligned on lines, the distance between the adjacent heat-conductive fillers 37 is shortened in the sheet width direction. Accordingly, a heat transfer route may be readily formed and the heat conductivity can be enhanced further. It is noted that the heat-conductive fillers 37 are not always necessary to be aligned on lines.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing member heated from inside; and a pressing member forming a fixing nip with the fixing member, in which a toner image transferred on a sheet is heated and pressed so as to be fixed on the sheet at the fixing nip through which the sheet is nipped and conveyed, wherein the fixing member includes, on an inner circumferential surface thereof, a heat absorbing layer containing heat-conductive fillers oriented in a direction intersecting with a conveying direction of the sheet, and a content of the heat-conductive fillers in the heat absorbing layer is 3 wt % to 60 wt %.

2. The fixing device according to claim 1, wherein the heat-conductive filler has a shape that a length in the direction intersecting with the sheet conveying direction is longer than a thickness in a thickness direction of the heat absorbing layer.

3. The fixing device according to claim 1, wherein the heat-conductive filler has a length in the direction intersecting with the sheet conveying direction longer than a thickness of the heat absorbing layer.

4. The fixing device according to claim 1, wherein the heat-conductive fillers are aligned on lines.

5. The fixing device according to claim 1, wherein the heat-conductive filler has a fibrous, needle-like or scale-like shape.

6. An image forming apparatus comprising the fixing device according to claim 1.

7. A fixing device comprising:

a fixing member heated from inside; and a pressing member forming a fixing nip with the fixing member, in which a toner image transferred on a sheet is heated and pressed so as to be fixed on the sheet at the fixing nip through which the sheet is nipped and conveyed, wherein the fixing member includes, on an inner circumferential surface thereof, a heat absorbing layer containing heat-conductive fillers oriented in a direction intersecting with a conveying direction of the sheet, and a heat conductivity of the heat-conductive filler in the heat absorbing layer is 100 W/(m·k) to 6000 W/(m·k).

8. An image apparatus comprising the fixing device according to claim 7.

9. A fixing device comprising:

a fixing member heated from inside; and a pressing member forming a fixing nip with the fixing member, in which a toner image transferred on a sheet is heated and pressed so as to be fixed on the sheet at the fixing nip through which the sheet is nipped and conveyed, wherein the fixing member includes, on an inner circumferential surface thereof, a heat absorbing layer containing heat-conductive fillers oriented in a direction intersecting with a conveying direction of the sheet, and wherein the fixing member includes:

a cylindrical core metal; and a release layer provided on an outer circumferential surface of the core metal with an adhesive layer, wherein the core metal has a thickness of 0.6 mm or less.

10. An image apparatus comprising the fixing device according to claim 9.

* * * * *